US010039163B2

(12) United States Patent
Mishima

(10) Patent No.: US 10,039,163 B2
(45) Date of Patent: Jul. 31, 2018

(54) SOLID-STATE LIGHT-EMITTING ELEMENT MODULE AND LIGHTING ASSEMBLY

(71) Applicant: Panasonic Intellectual Property Management Co., Ltd., Osaka (JP)

(72) Inventor: Masanori Mishima, Kyoto (JP)

(73) Assignee: Panasonic Intellectual Property Management Co., LTD., Osaka (JP)

( * ) Notice: Subject to any disclaimer, the term of this patent is extended or adjusted under 35 U.S.C. 154(b) by 0 days.

(21) Appl. No.: 15/048,328

(22) Filed: Feb. 19, 2016

(65) Prior Publication Data

US 2016/0270175 A1 Sep. 15, 2016

(30) Foreign Application Priority Data

Mar. 12, 2015 (JP) ..... 2015-050090

(51) Int. Cl.
*H05B 33/08* (2006.01)

(52) U.S. Cl.
CPC ..... *H05B 33/0824* (2013.01); *H05B 33/089* (2013.01); *H05B 33/0848* (2013.01)

(58) Field of Classification Search
CPC ..... H05B 33/0824; H05B 33/08; H05B 33/0806; H05B 33/0884; H05B 33/0842; H05B 33/0866; H05B 33/0848; H05B 33/089; H05B 33/0815; H05B 37/00; H05B 37/02; H01C 10/00; H01C 10/005; H01C 10/10; H01C 10/16; H01C 10/20
USPC ..... 315/297, 307–308, 291
See application file for complete search history.

(56) References Cited

U.S. PATENT DOCUMENTS 6,909,355 B2 * 6/2005 Hashimoto ..... H01C 10/34 338/162
8,564,210 B2 10/2013 Hamamoto et al.
2009/0103312 A1 * 4/2009 Batson ..... G09F 9/33 362/311.13
2011/0175938 A1 * 7/2011 Lee ..... G09G 3/3406 345/690
2011/0210675 A1 * 9/2011 Hamamoto ..... F21S 8/031 315/185 R
2014/0077697 A1 * 3/2014 Totani ..... H05B 33/0803 315/50
2014/0361693 A1 * 12/2014 Angelin ..... H05B 33/0842 315/152
2015/0028776 A1 * 1/2015 McMillan ..... H05B 33/0809 315/307

FOREIGN PATENT DOCUMENTS

JP 2011-181295 A 9/2011
JP WO 2012111041 A1 * 8/2012 ..... H05B 33/0815
WO WO 2015113095 A1 * 8/2015 ..... H05B 33/0815

* cited by examiner

*Primary Examiner* — Tung X Le
*Assistant Examiner* — Henry Luong
(74) *Attorney, Agent, or Firm* — Renner, Otto, Boisselle & Sklar, LLP

(57) ABSTRACT

An LED module includes: an LED disposed on a substrate; an input terminal and an output terminal for supplying current to the LED from a lighting circuit; an identification terminal for outputting to the lighting circuit an electric signal representing identification information for identifying electrical characteristics of the LED; and an identification information setter that is connected between the output terminal and the identification terminal and variably sets the identification information.

4 Claims, 8 Drawing Sheets

SOLID-STATE LIGHT-EMITTING ELEMENT MODULE AND LIGHTING ASSEMBLY

CROSS REFERENCE TO RELATED APPLICATION

This application claims the benefit of priority of Japanese Patent Application Number 2015-050090 filed on Mar. 12, 2015, the entire content of which is hereby incorporated by reference.

BACKGROUND OF THE INVENTION

1. Field of the Invention

The present disclosure relates to a solid-state light-emitting element module including a solid-state light-emitting element such as an LED (light-emitting diode), and to a lighting assembly including the solid-state light-emitting element module.

2. Description of the Related Art

A solid-state light-emitting element module including a solid-state light-emitting element such as an LED, as well as a lighting circuit which supplies current to the solid-state light-emitting element module, are conventionally known (for example, PTL (Patent Literature) 1: Japanese Unexamined Patent Application Publication No. 2011-181295). In the technique disclosed in PTL 1, the solid-state light-emitting element module is so configured as to be removably attached to the lighting circuit. In a situation such as where the solid-state light-emitting element module is damaged, this configuration allows only the solid-state light-emitting element module to be replaced.

SUMMARY OF THE INVENTION

Furthermore, PTL 1 discloses a configuration of a solid-state light-emitting element module that includes a connection terminal for outputting identification information in the form of electric signals (characteristics setting signals) in order that a plurality of solid-state light-emitting element modules having different electrical characteristics are available with a single lighting circuit. Herein, the identification information is information for identifying electrical characteristics of the solid-state light-emitting element module. With this, the lighting circuit disclosed in PTL 1 aims to output, based on the identification information, current adapted to the electrical characteristics of the solid-state light-emitting element modules.

However, PTL 1 discloses only the configuration of the solid-state light-emitting element module in which a circuit including a fixed resistor, etc., is connected between the connection terminal and an output terminal, and the identification information once set in this solid-state light-emitting element module cannot be changed. In other words, there is a problem in that even when a change in specification from high-output specification to high-efficiency specification is desired for a single solid-state light-emitting element module, for example, the specification cannot be changed due to the set identification information after the solid-state light-emitting element module is installed on a luminaire.

A solid-state light-emitting element module and a lighting assembly disclosed herein have been conceived to solve a problem such as that described above. An object of the present disclosure is to provide a solid-state light-emitting element module and a lighting assembly that are capable of changing identification information set in the solid-state light-emitting element module.

In order to achieve the aforementioned object, a solid-state light-emitting element module according to one aspect of the present disclosure includes: a solid-state light-emitting element disposed on a substrate; an input terminal and an output terminal for supplying current to the solid-state light-emitting element from a lighting circuit external to the solid-state light-emitting element module; an identification terminal for outputting to the lighting circuit an electric signal representing identification information for identifying an electrical characteristic of the solid-state light-emitting element; and an identification information setter that is connected between the identification terminal and at least one of the input terminal and the output terminal, and variably sets the identification information.

According to the present disclosure, it is possible to provide a solid-state light-emitting element module and a lighting assembly that are capable of changing identification information set in the solid-state light-emitting element module.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENTS

Hereinafter, exemplary embodiments are described with reference to the accompanying drawings. Note that each of the embodiments described below shows a preferred specific example of the present disclosure. Therefore, the numerical values, shapes, materials, structural elements, arrangement and connection of the structural elements, steps, the processing order of the steps etc., shown in the following embodiments are mere examples, and are not intended to limit the present disclosure. Consequently, among the structural elements in the following embodiments, structural elements not recited in any one of the independent claims which indicate the broadest concepts of the present disclosure are described as arbitrary structural elements.

Note that the respective figures are schematic diagrams and are not necessarily precise illustrations. Additionally, substantially the same structural elements in the figures share the same reference signs, and description that would overlap may be omitted or simplified.

1. Configurations of Luminaire and LED Module

First, configurations of a luminaire and an LED module according to this embodiment are described with reference to the drawings.

Figure 1:
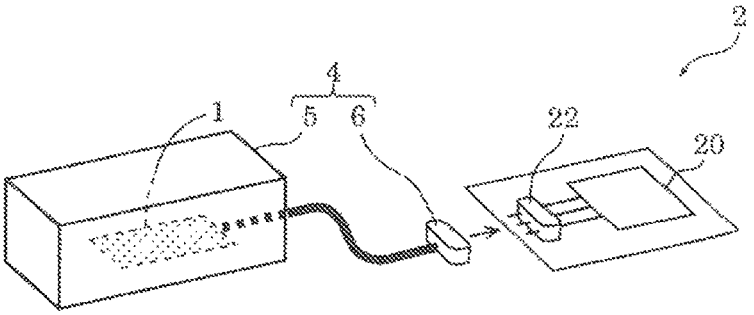
FIG. 1 is an external perspective view schematically illustrating an LED module and a luminaire according to an embodiment.
Figure 2:
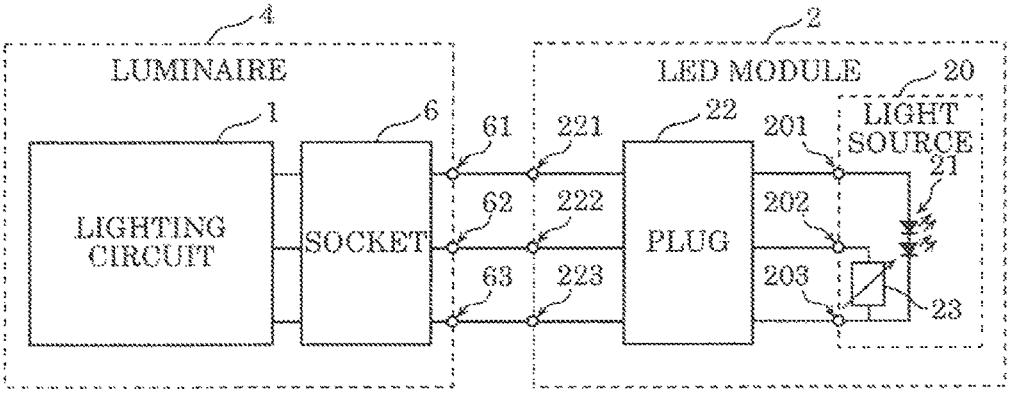
FIG. 2 is a schematic circuit diagram of an LED module and a luminaire according to an embodiment.

FIG. 1 is an external perspective view schematically illustrating LED module 2 and luminaire 4 according to this embodiment. FIG. 2 is a schematic circuit diagram of LED module 2 and luminaire 4 according to this embodiment.

As illustrated in FIG. 1, LED module 2 according to this embodiment is a solid-state light-emitting element module that emits illumination light when supplied with current from luminaire 4, and includes plug 22 which is connected to socket 6 of luminaire 4, and light source 20. Luminaire 4 is a device for supplying current to LED module 2, and includes power supply box 5 including lighting circuit 1, and socket 6.

As illustrated in FIG. 2, luminaire 4 according to this embodiment further includes output terminals 61 and 63 for supplying current to LED 21 of LED module 2, and output terminal 62 to which voltage that is an electric signal corresponding to identification information for identifying electrical characteristics of LED module 2 is applied. In this embodiment, output terminals 61 and 63 and output terminal 62 are included in socket 6.

Lighting circuit 1 supplies current to LED module 2. Details of lighting circuit 1 are described later.

Socket 6 is a coupling part that is connected to plug 22 of LED module 2, and includes output terminals 61, 62, and 63. The shape, structure, etc., of socket 6 are not particularly limited as long as they are adapted to plug 22.

Plug 22 is a coupling part that is connected to socket 6 and light source 20, and includes first connection terminal 221, second connection terminal 222, and third connection terminal 223 as illustrated in FIG. 2. The shape, structure, etc., of plug 22 are not particularly limited as long as they are adapted to socket 6.

First connection terminal 221 is one of the terminals of plug 22 and is connected to an anode-side end of LED 21.

Second connection terminal 222 is one of the terminals of plug 22, and is connected to identification information setter 23. Voltage corresponding to identification information is applied from luminaire 4 to second connection terminal 222.

Third connection terminal 223 is one of the terminals of plug 22 and is connected to a cathode-side end of LED 21.

First connection terminal 221, second connection terminal 222, and third connection terminal 223 are respectively connected to output terminals 61, 62, and 63 of socket 6 when plug 22 is connected to socket 6.

Light source 20 is a light emitter of LED module 2, and includes LED 21, identification information setter 23, input terminal 201, identification terminal 202, output terminal 203, and a substrate (not illustrated in the drawings) on which these parts are provided. In this embodiment, the substrate is formed of a planar substrate.

LED 21 is one or more solid-state light-emitting elements that are used as a light source of LED module 2. LED 21 is formed of a SMD (surface mount device) LED element, for example.

Input terminal 201 is connected to an anode side of LED 21 and used for supplying current from lighting circuit 1 to LED 21. Input terminal 201 is connected to high-voltage output terminal 61 of luminaire 4 via plug 22.

Identification terminal 202 is connected to identification information setter 23 and used for outputting to lighting circuit 1 an electric signal representing the identification information set by identification information setter 23. Identification terminal 202 is connected to output terminal 62 of luminaire 4 via plug 22.

Output terminal 203 is connected to a cathode side of LED 21 and used for supplying current from lighting circuit 1 to LED 21. Output terminal 203 is connected to low-voltage output terminal 63 of luminaire 4 via plug 22.

Identification information setter 23 is a circuit connected between identification terminal 202 and output terminal 203 and used for variably setting identification information for identifying electrical characteristics of LED 21. In this embodiment, identification information setter 23 is configured to variably set the identification information, or more specifically, is configured to connect identification terminal 202 and output terminal 203 to each other via a variable resistor or the like. In this case, a resistance value of the variable resistor is the identification information. Hereinafter, the above-stated configuration is described.

Although identification information setter 23 is disposed between identification terminal 202 and output terminal 203 in this embodiment, identification information setter 23 may be disposed between identification terminal 202 and input terminal 201.

Figure 3:
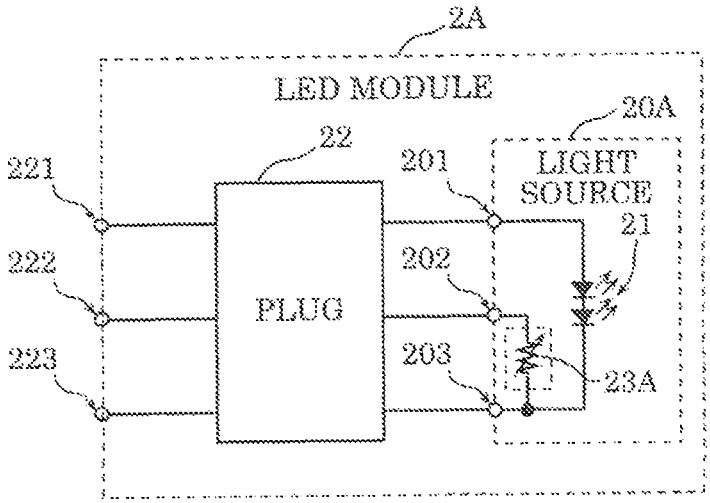
FIG. 3 is a circuit diagram illustrating one example of a configuration of an LED module according to an embodiment.

The following describes a specific configuration of identification information setter 23 with reference to FIG. 3.

FIG. 3 is a circuit diagram illustrating a configuration of LED module 2A according to Embodiment 1. As illustrated in this figure, in light source 20A of LED module 2A, variable resistor 23A is connected in series with and between identification terminal 202 and output terminal 203. In light source 20A, a resistance value of variable resistor 23A is associated with electrical characteristics of LED 21 and set as identification information. With variable resistor 23A connected to identification terminal 202 and output terminal 203, the identification information can be output in the form of identification signals (electric signals) from identification terminal 202.

With the above-described configuration, when a change in specification from high-output specification to high-efficiency specification is desired for single LED module 2, for example, reconfiguration is required to decrease a value of current that is supplied to LED 21. In this case, even after LED module 2 is installed on a luminaire, the resistance value of variable resistor 23A can be changed according to the above change in specification This makes it possible to change the identification information set in LED module 2 (the resistance value of variable resistor 23A). Furthermore, upon a change in specification, directly controlling LED module 2 is sufficient without the need to adjust lighting circuit 1, meaning that the control for adjustment is simpler than it used to be.

2. Configuration of Lighting Circuit

Next, a configuration of lighting circuit 1 according to this embodiment is described with reference to the drawings.

Figure 4:
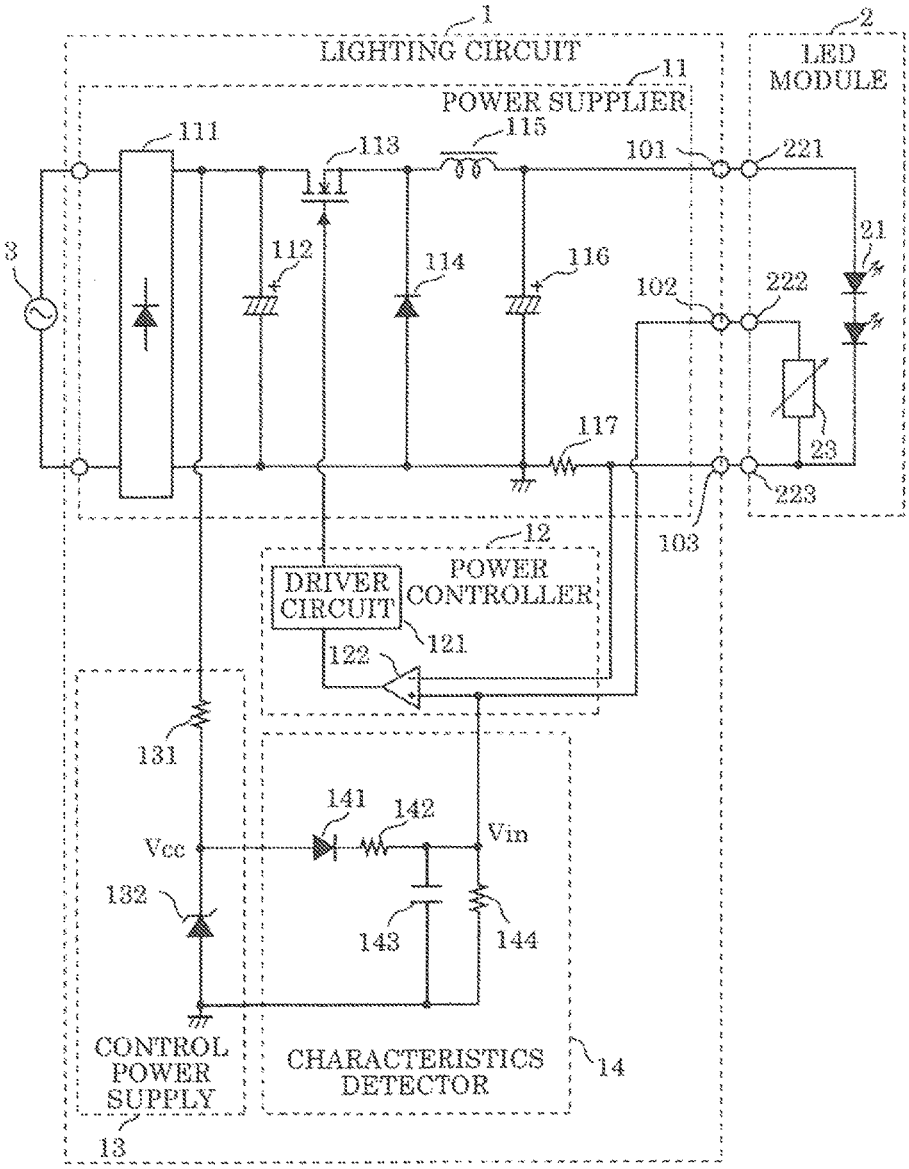
FIG. 4 is a circuit diagram illustrating a configuration of a lighting circuit according to an embodiment.

FIG. 4 is a circuit diagram illustrating a configuration of lighting circuit 1 according to this embodiment. In addition to lighting circuit 1, LED module 2 and AC (alternating-current) power supply 3 which supplies electrical power to lighting circuit 1 are illustrated in FIG. 4.

AC power supply 3 outputs AC voltage and is a system power supply such as a commercial power supply which outputs AC voltage of 100 V to 242 V, for example.

As illustrated in FIG. 4, lighting circuit 1 includes power supplier 11, power controller 12, control power supply 13, and characteristics detector 14. Furthermore, lighting circuit 1 includes output terminal 101, identification terminal 102, and reference terminal 103.

Output terminal 101 and reference terminal 103 are terminals that are respectively electrically connected to input terminal 201 and output terminal 203 of light source 20 via first connection terminal 221 and third connection terminal 223 and from which current is output to LED module 2.

Identification terminal 102 is electrically connected to identification terminal 202 of light source 20 via second connection terminal 222 and receives an identification signal (an electric signal) corresponding to the identification information set by identification information setter 23.

Note that there are cases where socket 6 and plug 22 are omitted from the description of connection between luminaire 4 and LED module 2 in the following embodiments. Specifically, an electrical connection between luminaire 4 and LED module 2 is described as if output terminal 101, identification terminal 102, and reference terminal 103 of lighting circuit 1 are directly connected to input terminal 201, identification terminal 202, and output terminal 203 of light source 20, respectively. This means that socket 6 and plug 22 are not essential structural elements of luminaire 4 and LED module 2 according to this embodiment.

Power supplier 11 is a circuit that supplies constant DC (direct current) to LED module 2. In this embodiment, power supplier 11 converts to DC voltage AC voltage input from AC power supply 3, and additionally performs DC-to-DC conversion, thereby generating constant DC. As illustrated in FIG. 4, power supplier 11 includes rectifier 111, capacitors 112 and 116, switching element 113, diode 114, inductor 115, and resistor 117.

Rectifier 111 is a circuit that rectifies AC voltage input from AC power supply 3. Rectifier 111 includes a diode bridge, for example.

Capacitor 112 is an element that is connected to an output terminal of rectifier 111 and is used for smoothing pulsing DC voltage output from rectifier 111. Furthermore, a series circuit including switching element 113 and diode 114 is connected to both ends of capacitor 112. In this embodiment, capacitor 112 is formed of an electrolytic capacitor.

Switching element 113 is an element that performs a switching operation (repeats turning ON and OFF) under control of power controller 12; in this embodiment, switching element 113 is an N-channel MOSFET (metal-oxide semiconductor field-effect transistor) connected in series with inductor 115.

Diode 114 is a rectifier that forms a loop circuit together with LED 21 in LED module 2 and inductor 115 and recovers energy stored in inductor 115. A cathode terminal of diode 114 is connected to a connection point between switching element 113 and inductor 115, and an anode terminal of diode 114 is connected to a low-voltage output terminal of rectifier 111. Furthermore, a series circuit including inductor 115 and capacitor 116 is connected to both ends of diode 114.

Inductor 115 is a choke coil, and stores and releases energy according to a switching operation of switching element 113.

Capacitor 116 is an element that is connected in parallel with LED 21 and smoothes pulsating voltage that occurs at inductor 115, etc. In this embodiment, capacitor 116 is formed of an electrolytic capacitor.

Resistor 117 is a sense resistor connected in series with LED 21 and used for detecting current that flows to LED 21, that is, an output current of power supplier 11.

Power controller 12 is a circuit that detects an output current of power supplier 11 by detecting voltage that is applied to resistor 117 of power supplier 11, and performs, based on the detected output current, feedback control on the output current of power supplier 11. As illustrated in FIG. 4, power controller 12 includes driver circuit 121 and comparator 122.

Driver circuit 121 performs control of causing switching element 113 to repeat turning ON and OFF (i.e., perform a switching operation). The control by driver circuit 121 allows the output current of power supplier 11 to be maintained substantially constant.

Comparator 122 is a circuit that compares voltage corresponding to the output current of power supplier 11 with voltage corresponding to a target value of the output current that is input from characteristics detector 14. Voltage that is applied to resistor 117 of power supplier 11 is input to an inverting input terminal of comparator 122. Voltage corresponding to a target value of the output current of power supplier 11 is input from characteristics detector 14 to a non-inverting input terminal of comparator 122. The voltage that is input to the non-inverting input terminal of comparator 122 corresponds to identification information set by identification information setter 23 of LED module 2. An output of comparator 122 is input to driver circuit 121.

Control power supply 13 is a circuit that applies constant voltage $V_{cc}$ to characteristics detector 14. As illustrated in FIG. 4, control power supply 13 includes resistor 131 and Zener diode 132.

Resistor 131 is an element for limiting current that flows to Zener diode 132.

Zener diode 132 is an element for stabilizing voltage that is applied to characteristics detector 14. Voltage that is applied across Zener diode 132 is approximately 15 V, for example.

Characteristics detector 14 is a circuit that detects characteristics of LED module 2 based on the identification information set by identification information setter 23. Characteristics detector 14 outputs to power controller 12 voltage determined based on the result of the detection. This voltage corresponds to a target value of current which power supplier 11 outputs. As illustrated in FIG. 4, characteristics detector 14 includes diode 141, resistors 142 and 144, and capacitor 143.

Diode 141 is a rectifying element for preventing current from flowing toward control power supply 13.

Resistors 142 and 144 are elements among which voltage applied by control power supply 13 is divided. A connection point between resistor 142 and resistor 144 is connected to second connection terminal 222 and identification terminal 202 of LED module 2. With this, voltage $V_{in}$ which is the identification signal is applied to this connection point. Resistance value $R_{144}$ of resistor 144 is set to a value sufficiently greater than resistance value $R_{142}$ of resistor 142 and resistance value $R_{23}$ of variable resistor 23A which is used in identification information setter 23 of LED module 2. For example, when resistance values $R_{144}$ and $R_{23}$ are approximately 1 kΩ to several tens of kilo-ohms, resistance value $R_{144}$ is approximately several tens of mega-ohms.

Capacitor 143 is an element for reducing noise that is added to voltage $V_{in}$ which is the identification signal.

With lighting circuit 1 configured as described above, voltage $V_{in}$ which is the identification signal is determined as follows according to the configuration of identification information setter 23 of LED module 2, that is, the configuration of connection between identification terminal 202 and output terminal 203.

Figure 5:
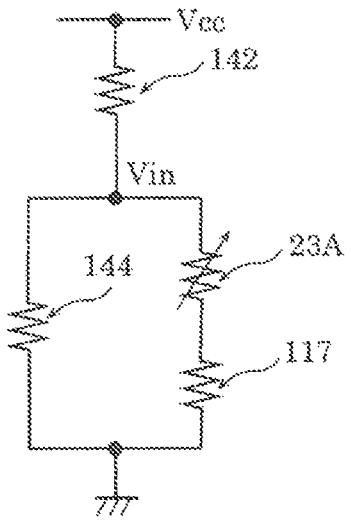
FIG. 5 is an equivalent circuit schematic of a circuit that determines voltage of an identification signal according to an embodiment.

FIG. 5 is an equivalent circuit schematic of a circuit that determines voltage $V_{in}$ of the identification signal according to this embodiment. As illustrated in this figure, a series circuit including variable resistor 23A and resistor 117 is connected to resistor 144 in parallel. In the equivalent circuit schematic illustrated in FIG. 5, resistance value $R_{117}$ of resistor 117 is sufficiently smaller than resistance value $R_{23}$, and therefore resistor 117 can be ignored. Furthermore, resistance value $R_{144}$ is sufficiently larger than resistance value $R_{23}$, and therefore, combined resistance of a circuit including resistors 144 and 117 and variable resistor 23A is substantially equal to resistance value $R_{23}$. Accordingly, voltage $V_{in}$ of the identification signal is represented by Expression 1 below.

$$V_{in}=V_{cc}\times R_{23}/(R_{142}+R_{23}) \quad \text{Expression 1}$$

Thus, when identification terminal 202 and output terminal 203 of LED module 2 are connected to each other via variable resistor 23A, lighting circuit 1 is capable of supplying LED module 2 with current corresponding to resistance value $R_{23}$ of resistor 23A which is identification information. Specifically, lighting circuit 1 inputs voltage $V_{in}$ corresponding to the identification information from characteristics detector 14 to power controller 12, to perform such feedback control that voltage corresponding to the output current of power supplier 11 is substantially equal to voltage $V_{in}$.

The above-described configurations of LED module 2 and lighting circuit 1 makes it possible to, when changing the specification of LED module 2, change resistance value $R_{23}$ of variable resistor 23A which is the identification information even after LED module 2 is installed on luminaire 4. Specifically, LED module 2 is capable of variably setting resistance value $R_{23}$ as identification information, and lighting circuit 1 is capable of changing voltage $V_{in}$ which is the identification signal along with a change in the setting of the identification information, according to Expression 1. Furthermore, upon a change in specification, directly controlling LED module 2 is sufficient without the need to adjust lighting circuit 1, meaning that the control for adjustment is simpler than it used to be.

3. Specific Configuration of Identification Information Setter

As specific configuration examples of identification information setter 23, Examples 1 to 3 are described below.

3-1. First Lighting Assembly

Figure 6:
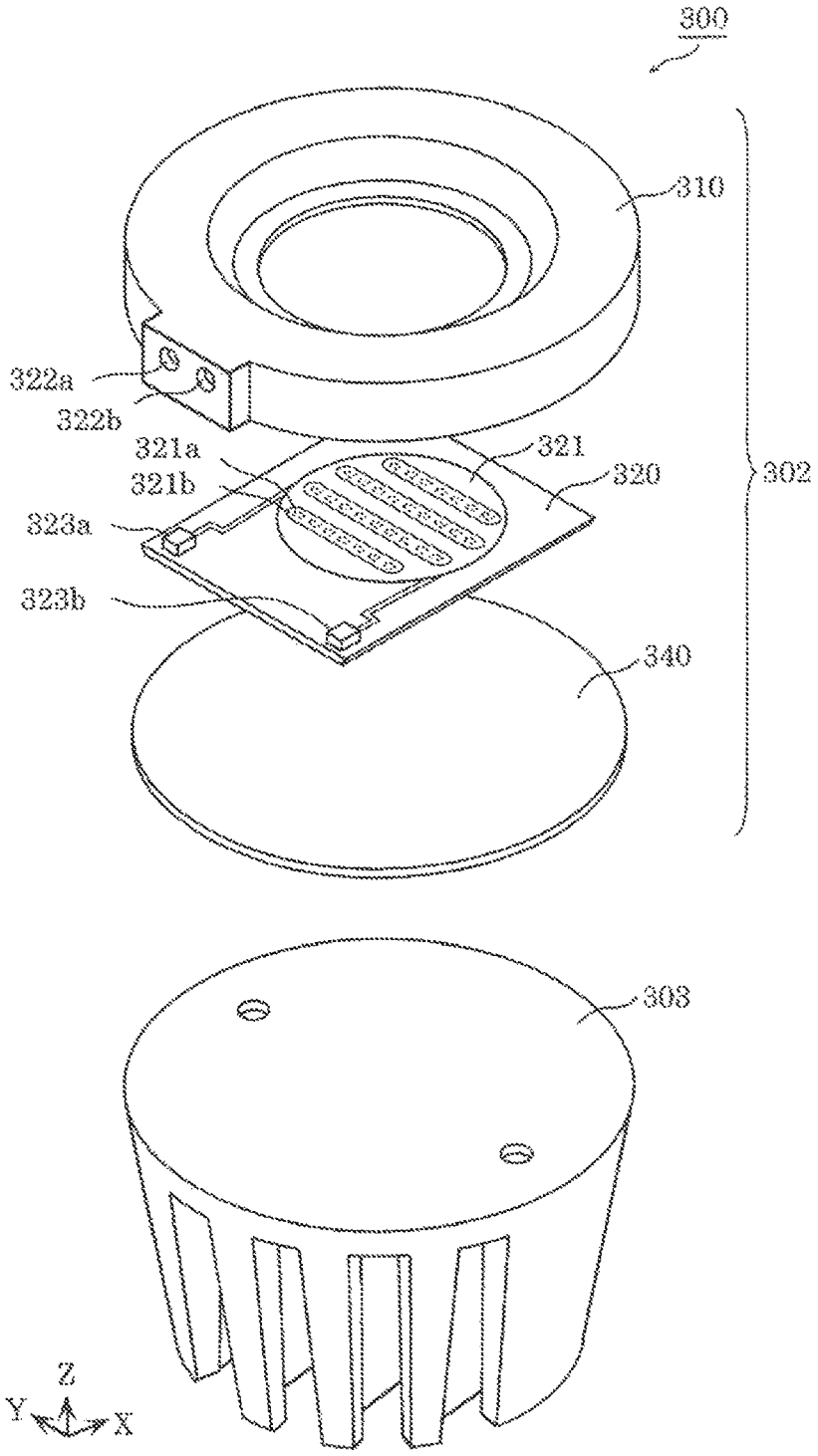
FIG. 6 is an exploded perspective view of a first lighting assembly according to an embodiment.

FIG. 6 is an exploded perspective view of a first lighting assembly according to an embodiment. In the illustration, a side on which light is retrieved from lighting assembly 300 (hereinafter referred to as a light-emitting side) corresponds to the upper side of FIG. 6. As illustrated in FIG. 6, lighting assembly 300 includes LED module 302 and luminaire 303. LED module 302 is a low-profile light source for illumination, the overall shape of which is a circle. LED module 302 includes housing 310, support base 340, and LED substrate 320.

Housing 310 is an annular, disk-shaped housing disposed on the light-emitting side of LED module 302. Housing 310 has an opening and is connected to support base 340. LED substrate 320 is disposed between housing 310 and support base 340.

With the above-described configuration, LED 321 on LED substrate 320 is exposed through the opening of housing 310.

Housing 310 is formed of, for example, a resin housing made from a synthetic resin having electrically insulating properties, such as PBT (polybutylene terephthalate).

Housing 310 includes insertion holes 322*a* and 322*b*. An end of a lead wire extending from luminaire 303 passes through insertion holes 322*a* and 322*b*. The lead wire extending from luminaire 303 has one end connected to a positive output terminal of a lighting circuit included in luminaire 303 and the other end connected to a negative output terminal of the lighting circuit.

LED substrate 320 is a substrate on which one or more light-emitting elements such as semiconductor light-emitting elements are provided. For example, LED substrate 320 is a rectangular, planar substrate having a first main surface on which the light-emitting elements are provided and a second main surface, opposite from the first main surface, which is connected to support base 340. LED substrate 320 is preferably made from a material having high thermal conductivity and, for example, is formed of an alumina substrate made from alumina. On the first main surface of LED substrate 320, LED 321 is provided which has one or more light-emitting elements that emit light forward.

Specifically, LED 321 includes one or more LED chips 321*a* and sealing member 321*b* which are attached to LED substrate 320. As LED chip 321*a*, a blue LED chip is used, for example, which emits light having a central wavelength of 440 nm to 470 nm.

An example of sealing member 321*b* is a phosphor-containing resin made from resin containing a phosphor that converts the wavelength of light emitted from LED chip 321*a* as well as protecting LED chip 321*a* by sealing LED chip 321*a*.

Input terminal 323*a* and output terminal 323*b* are disposed on an edge of LED substrate 320. Electrical power from lighting circuit 1 of luminaire 303 is supplied to each LED chip 321*a* via input terminal 323*a* and output terminal 323*b*, causing LED 321 to emit light.

Support base 340 is a pedestal to which LED substrate 320 is attached.

Although a configuration in which housing 310 and support base 340 are held is not illustrated in FIG. 6, an example of the configuration is housing 310 with claw portions and support base 340 with fitting portions for these claw portions. Another example of the configuration is housing 310 and support base 340 screwed together.

Figure 7A:
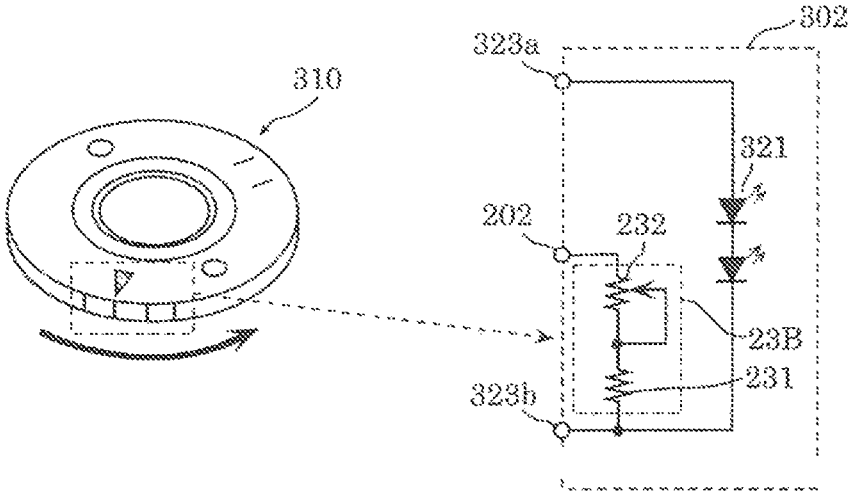
FIG. 7A illustrates a configuration of an identification information setter according to Example 1.
Figure 7B:
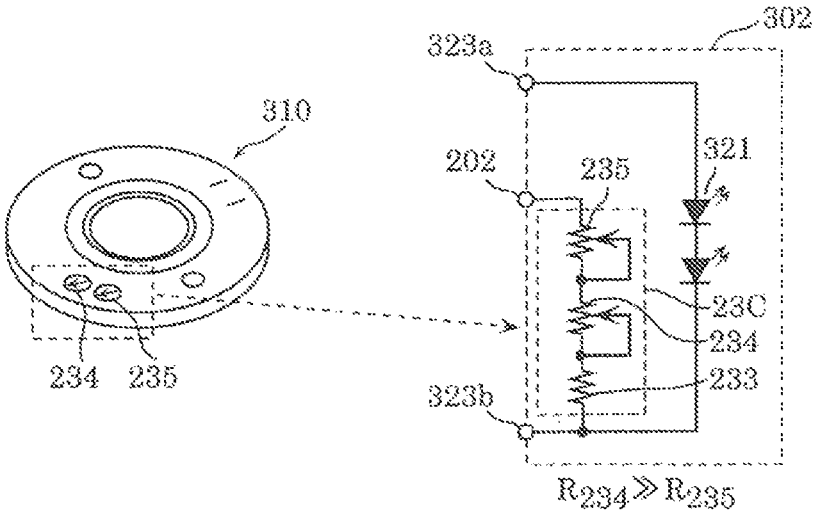
FIG. 7B illustrates a configuration of an identification information setter according to Example 2.

In LED module 302 having a configuration such as that illustrated in FIG. 6, identification information setter 23 may be disposed as in FIG. 7A or FIG. 7B.

3-1-1. Example 1 of Identification Information Setter

FIG. 7A illustrates a configuration of an identification information setter according to Example 1. Only housing 310 of LED module 302 illustrated in FIG. 6 appears on the left side of FIG. 7A. Identification information setter 23B illustrated on the right side of FIG. 7A is embedded in housing 310.

As illustrated on the right side of FIG. 7A, LED module 302 includes LED 321, input terminal 323*a*, output terminal 323*b*, identification terminal 202, and identification information setter 23B. Identification information setter 23B includes variable resistor 232 and resistor 231. Variable resistor 232 and resistor 231 are connected in series between identification terminal 202 and output terminal 323*b*. Variable resistor 232 is disposed, for example, inside housing 310.

With the above-described configuration, housing 310 rotates along the circumference of housing 310 as illustrated on the left side of FIG. 7A. Accordingly, a contact point between housing 310 and LED substrate 320 or support base 340 changes, allowing a change in the resistance value of variable resistor 232 embedded in housing 310. This means that when a change in light-emitting specification of LED module 302 is desired, it is possible to change the resistance value of variable resistor 232 by rotating housing 310 in the circumferential direction even after LED module 302 is installed on luminaire 303. With this, identification information set in LED module 302 can be changed.

Identification information setter 23B includes resistor 231 having a fixed resistance value connected in series with variable resistor 232. With this, it is possible to avoid that identification information indicating a resistance value of 0Ω is set by identification information setter 23B. Consequently, it is possible to prevent a large current from flowing to lighting circuit 1 when lighting circuit 1 detects an identification signal.

3-1-2. Example 2 of Identification Information Setter

FIG. 7B illustrates the second example of the specific configuration of the identification information setter according to Example 2. Only housing 310 of LED module 302 illustrated in FIG. 6 appears on the left side of FIG. 7B. Identification information setter 23C illustrated on the right side of FIG. 7B is embedded in housing 310.

As illustrated on the right side of FIG. 7B, LED module 302 includes LED 321, input terminal 323*a*, output terminal 323*b*, identification terminal 202, and identification information setter 23C. Identification information setter 23C includes variable resistors 234 and 235 and resistor 233. Variable resistors 234 and 235 and resistor 233 are connected in series between identification terminal 202 and output terminal 323*b*. Variable resistors 234 and 235 are disposed, for example, inside housing 310. Furthermore, identification information setter 23C includes, on a surface of housing 310, a resistance adjustor that adjusts resistance values of variable resistors 234 and 235. The resistance adjustor is, for example, a trimmer capable of adjusting the resistance values of variable resistors 234 and 235 by use of, for example, a screw driver as illustrated in FIG. 7B.

With the above-described configuration, the resistance adjustor on housing 310 is adjusted using a screw driver as illustrated on the left side of FIG. 7B. By doing so, it is possible to independently change the resistance values of embedded variable resistors 234 and 235. This means that when a change in light-emitting specification of LED module 302 is desired, it is possible to change the resistance values of variable resistor 234 and 235 by adjusting the resistance adjuster on housing 310 even after LED module 302 is installed on luminaire 303. With this, identification information set in LED module 302 can be changed.

Note that in the case where identification information setter 23 includes two or more variable resistors just as in this example, variable resistor 235 may have a maximum resistance value of at most one-tenth of a maximum resistance value of variable resistor 234, for example. With this, a combined resistance value of identification information setter 23C can be roughly adjusted by use of variable resistor 234 and finely adjusted by use of variable resistor 235. This means that it is possible to set an accurate combined resistance value as the identification information of identification information setter 23C.

Note that also in this example, identification information setter 23C includes resistor 233 having a fixed resistance value connected in series with variable resistors 234 and 235. With this, it is possible to avoid that identification information indicating a resistance value of 0Ω is set by identification information setter 23C. Consequently, when lighting circuit 1 detects an identification signal, it is possible to prevent a large current from flowing to lighting circuit 1.

3-2. Second Lighting Assembly

Figure 8:
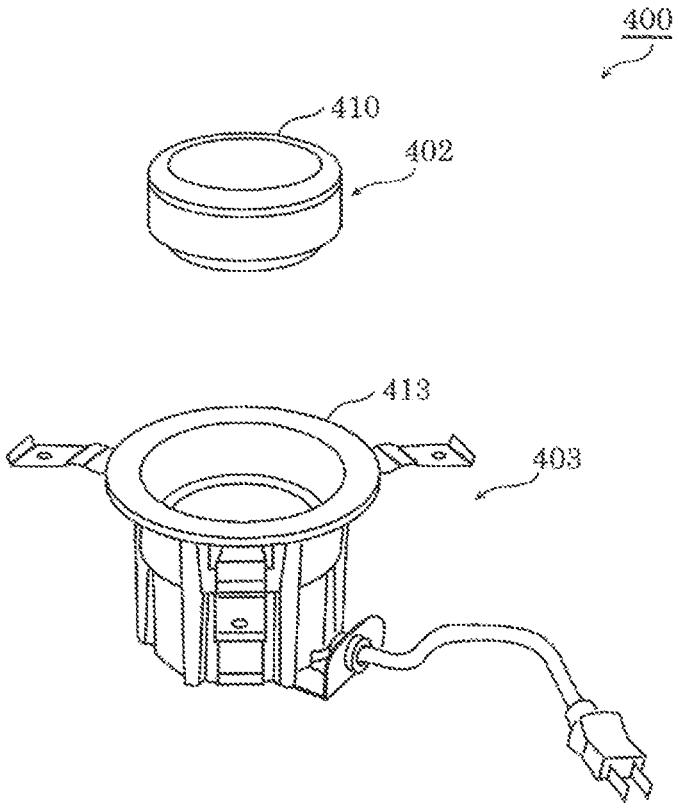
FIG. 8 is an exploded perspective view of a second lighting assembly according to an embodiment.

FIG. 8 is an exploded perspective view of a second lighting assembly according to Embodiment 1. In the illustration, a side on which light is retrieved from lighting assembly 400 corresponds to the upper side of FIG. 8. As illustrated in FIG. 8, lighting assembly 400 includes LED module 402 and luminaire 403. Luminaire 403 includes lighting circuit 1, socket 6 (not illustrated in the drawings) for connecting LED module 402, and lamp mount 413 to which LED module 402 is fitted. LED module 402 includes housing 410 having, on an external surface, plug 22 for connecting to socket 6 of luminaire 403.

3-2-1. Example 3 of Identification Information Setter

Figure 9:
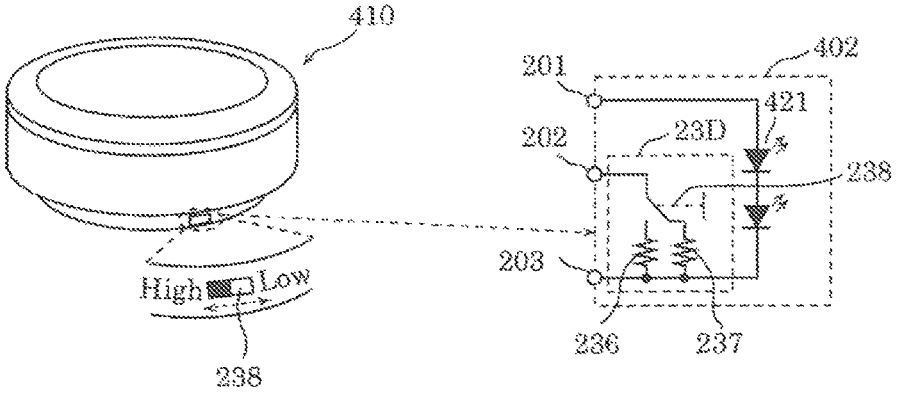
FIG. 9 illustrates a configuration of an identification information setter according to Example 3.

FIG. 9 illustrates a configuration of an identification information setter according to Example 3. Only housing 410 of LED module 402 illustrated in FIG. 8 appears on the left side of FIG. 9. Identification information setter 23D illustrated on the right side of FIG. 9 is embedded in housing 410.

As illustrated on the right side of FIG. 9, LED module 402 includes LED 421, input terminal 201, output terminal 203, identification terminal 202, and identification information setter 23D. Identification information setter 23D includes resistors 236 and 237 in parallel and switch 238 between identification terminal 202 and output terminal 203. Resistors 236 and 237 are a first resistor and a second resistor, respectively, having different fixed resistance values. One terminal of resistor 236 and one terminal of resistor 237 are connected to output terminal 203. One terminal of switch 238 is connected to identification terminal 202, and the other terminal of switch 238 is connected selectively to one of the other terminal of resistor 236 and the other terminal of resistor 237. In other words, switch 238 switches between the connection of output terminal 203, resistor 236, and identification terminal 202 and the connection of output terminal 203, resistor 237, and identification terminal 202. Identification information setter 23D with the above-described configuration is disposed, for example, inside housing 410.

In the above-described configuration, switch 238 is, for example, a slide switch that selects one of resistors 236 and 237 to connect to by sliding a button as illustrated on the left side of FIG. 9. As a result of sliding this slide switch 238, a resistance value of identification information setter 23D embedded in housing 410 can be changed. This means that when a change in light-emitting specification of LED module 402 is desired, it is possible to change the resistance values of identification information setter 23D by sliding switch 238 even after LED module 402 is installed on luminaire 403. With this, identification information set in LED module 402 can be changed.

Switch 238 is preferably disposed on LED module 402 (housing 410), on a surface recessed inward from an outermost exterior thereof as illustrated in FIG. 9. This makes it possible to avoid inadvertently operating switch 238 when attaching LED module 402 to luminaire 403.

3-3. Example 4 of Identification Information Setter

Figure 10:
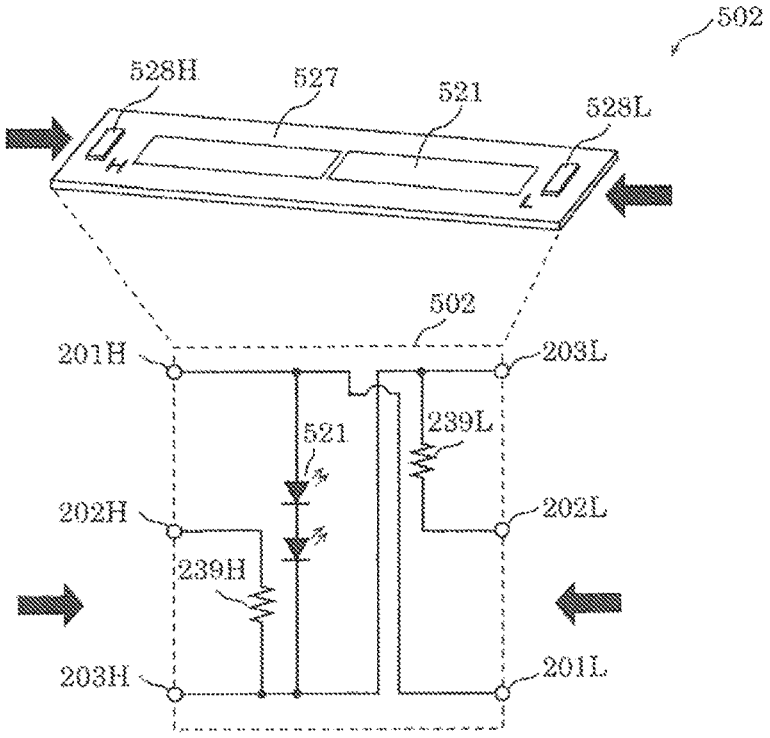
FIG. 10 illustrates a configuration of an identification information setter according to Example 4.

FIG. 10 illustrates a configuration of an identification information setter according to Example 4. An external perspective view of LED module 502 according to Example 4 appears on the upper side of FIG. 10. A circuit diagram of LED module 502 according to Example 4 appears on the lower side of FIG. 10.

As illustrated on the upper side of FIG. 10, LED module 502 includes substrate 527, LED 521, connectors 528H and 528L, and identification information setter 23E (not illustrated in the drawings).

As illustrated on the lower side of FIG. 10, LED module 502 includes LED 521, input terminals 201H and 201L, output terminals 203H and 203L, identification terminals 202H and 202L, and identification information setter 23E (not illustrated in the drawings).

Identification information setter 23E includes resistor 239H connected in series between identification terminal 202H and output terminal 203H and resistor 239L connected in series between identification terminal 202L and output terminal 203L. A resistance value of resistor 239H is greater than a resistance value of resistor 239L. Identification terminals 202H and 202L are a first identification terminal and a second identification terminal, respectively, for outputting to lighting circuit 1 an identification signal (an electric signal) corresponding to identification information set by identification information setter 23E. Input terminals 201H and 201L are electrically connected, and output terminals 203H and 203L are electrically connected. A wire connecting input terminals 201H and 201L and a wire connecting output terminals 203H and 203L are disposed in such a way as to cross each other on substrate 527.

Connector 528H includes input terminal 201H, identification terminal 202H, and output terminal 203H. Input terminal 201H, identification terminal 202H, output terminal 203H of connector 528H can be connected to output terminal 101, identification terminal 102, and reference terminal 103 of lighting circuit 1, respectively, via plug 22 and socket 6.

Connector 528L includes input terminal 201L, identification terminal 202L, and output terminal 203L. Input terminal 201L, identification terminal 202L, output terminal 203L of connector 528L can be connected to output terminal 101, identification terminal 102, and reference terminal 103 of lighting circuit 1, respectively, via plug 22 and socket 6.

With the above-described configuration, it is possible to selectively set one of resistors 239H and 239L as the identification information by selectively connecting one of connectors 528H and 528L to lighting circuit 1. Thus, when one of connectors 528H and 528L is connected to lighting circuit 1, the resistance value of identification information setter 23E can be changed. When a change in light-emitting specification of LED module 502 is desired, it is possible to change the resistance value of identification information setter 23E by changing the connector that is to be connected to lighting circuit 1. With this, identification information set in LED module 502 can be changed.

An indication that can show electrical characteristics of LED module 502 (for example, "H" and "L") may be added to LED module 502 around the connectors. This improves the operability for changing specification.

4. Advantageous Effects, etc.

As described above, LED module 2 according to this embodiment includes: LED 21 disposed on a substrate; input terminal 201 and output terminal 203 for supplying current to LED 21 from lighting circuit external to LED module 2; identification terminal 202 for outputting to lighting circuit 1 an electric signal representing identification information for identifying an electrical characteristic of LED 21; and identification information setter 23 that is connected between identification terminal 202 and at least one of input terminal 201 and output terminal 203, and variably sets the identification information.

With this, when a change in light-emitting specification of LED module 2 is desired, the identification information set in LED module 2 can be changed even after LED module 2 is installed on a luminaire.

In LED module 2A according to this embodiment, identification information setter 23 may include variable resistor 23A connected between identification terminal 202 and one of input terminal 201 and output terminal 203.

With this, when a change in light-emitting specification of LED module 2A is desired, the resistance value of variable resistor 23A can be changed even after LED module 2A is installed on a luminaire. With this, it is possible to change the identification information according to a change in the specification of LED module 2A. Furthermore, upon a change in specification, directly controlling LED module 2 is sufficient without the need to adjust lighting circuit 1, meaning that the control for adjustment is simpler than it used to be.

In LED module 302 according to this embodiment, the variable resistor includes variable resistors 234 and 235 connected in series between identification terminal 202 and one of input terminal 323*a* and output terminal 323*b*, and variable resistor 235 may have a maximum resistance value of at most one-tenth of a maximum resistance value of variable resistor 234.

With this, a combined resistance value of identification information setter 23C can be roughly adjusted by use of variable resistor 234 and finely adjusted by use of variable resistor 235. Accordingly, it is possible to set an accurate combined resistance value as the identification information of identification information setter 23C.

Furthermore, LED module 302 according to this embodiment may include: a solid-state light-emitting element unit including the substrate and LED 21; and housing 310 including identification information setter 23B and having an annular shape with an opening, and the solid-state light-emitting element unit may be disposed in the opening, and a resistance value of variable resistor 232 may change by rotation of housing 310 along a circumference of housing 310.

With this, it is possible to change the resistance value of variable resistor 232 by rotating housing 310 in the circumferential direction even after LED module 302 is installed on luminaire 303. Accordingly, identification information set in LED module 302 can be changed.

Furthermore, LED module 302 according to this embodiment may include: a solid-state light-emitting element unit including the substrate and LED 21; and housing 310 including identification information setter 23C and having an annular shape with an opening, and the solid-state light-emitting element unit may be disposed in the opening, and the identification information setter may include, on a surface of housing 310, a resistance adjustor that adjusts resistance values of variable resistors 234 and 235.

With this, it is possible to independently change the resistance values of variable resistors 234 and 235. This means that it is possible to change the resistance values of variable resistors 234 and 235 by adjusting the resistance adjustor on housing 310. Accordingly, identification information set in LED module 302 can be changed.

Furthermore, in LED module 402 according to this embodiment, identification information setter 23D may include: resistor 236 and resistor 237 having different resistance values and disposed in parallel between identification terminal 202 and one of input terminal 201 and output terminal 203; and switch 238 that switches between connection of resistor 236, identification terminal 202, and one of input terminal 201 and output terminal 203, and connection of resistor 237, identification terminal, 202 and the one of input terminal 201 and output terminal 203.

With this, it is possible to change the resistance value of identification information setter 23D by operating switch 238. Accordingly, identification information set in LED module 402 can be changed.

Furthermore, in LED module 402 according to this embodiment, switch 238 may be a slide switch element disposed on LED module 402, on a surface recessed inward from an outermost exterior of LED module 402.

With this, it is possible to change the resistance value of identification information setter 23D by sliding switch 238. Moreover, it is possible to avoid inadvertently operating switch 238 when attaching LED module 402 to luminaire 403.

Furthermore, LED module 502 according to this embodiment may include: identification terminal 202H and identification terminal 202L for outputting to lighting circuit 1 an electric signal representing the identification information set by the identification information setter, and the identification information setter includes: resistor 239H connecting identification terminal 202H and one of input terminal 201H and output terminal 203H; and resistor 239L having a resistance value different from a resistance value of resistor 239H and connecting identification terminal 202L and one of input terminal 201L and output terminal 203L, and identification information setter may variably generate the identification signal when input terminal 201L, output terminal 203L, and one of identification terminal 202H and identification terminal 202L are connected to lighting circuit 1.

With this, it is possible to selectively set one of resistors 239H and 239L as the identification information by selectively connecting one of connectors 528H and 528L to lighting circuit 1. This means that it is possible to change the resistance value of identification information setter 23E by changing the connector that is to be connected to lighting circuit 1. Accordingly, identification information set in LED module 502 can be changed.

Furthermore, a lighting assembly according to this embodiment includes: any one of the above-described LED modules; and luminaire 4 including lighting circuit 1.

Since such a lighting assembly includes any one of LED modules 2, 2A, 302, 402, and 502 according to the above-described embodiments and examples, and lighting circuit 1, it is possible to produce the same or similar advantageous effects as those produced by a corresponding one of the above-described embodiments and examples.

VARIATIONS AND OTHERS

Although the solid-state light-emitting element module and the lighting assembly according to the embodiments and the examples have been described above, the present disclosure is not limited to these embodiments and examples.

For example, although LED 21 is formed of an SMD LED element in the above embodiments and examples, this is not the only example. For example, an LED chip mounted on a substrate per se may be adopted as LED 21.

Furthermore, although LED 21 is used as a solid-state light-emitting element in the above embodiments, other solid-state light-emitting elements such as an organic EL (electroluminescence) element may be used.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A solid-state light-emitting element module comprising:

a solid-state light-emitting element disposed on a substrate;

an input terminal and an output terminal for supplying current to the solid-state light-emitting element from a lighting circuit external to the solid-state light-emitting element module;

an identification terminal for outputting to the lighting circuit an electric signal representing identification information for identifying an electrical characteristic of the solid-state light-emitting element;

a variable resistor that is connected between the identification terminal and at least one of the input terminal and the output terminal, and variably sets the identification information when the solid-state light-emitting element remains connected between the input terminal and the output terminal without being replaced by another solid-state light-emitting element; and a housing including the variable resistor and having an annular shape with an opening, wherein a solid-state light-emitting element unit including the substrate and the solid-state light-emitting element is disposed in the opening, the variable resistor includes, on a surface of the housing, a trimmer that adjusts a resistance value of the variable resistor, the variable resistor includes a first variable resistor and a second variable resistor connected in series between the identification terminal and one of the input terminal and the output terminal, and the second variable resistor has a maximum resistance value of at most one-tenth of a maximum resistance value of the first variable resistor.

2. A lighting assembly comprising:

the solid-state light-emitting element module according to claim 1; and a luminaire including the lighting circuit.

3. A solid-state light-emitting element module comprising:

a solid-state light-emitting element disposed on a substrate;

an input terminal and an output terminal for supplying current to the solid-state light-emitting element from a lighting circuit external to the solid-state light-emitting element module;

an identification terminal for outputting to the lighting circuit an electric signal representing identification information for identifying an electrical characteristic of the solid-state light-emitting element;

a variable resistor that is connected between the identification terminal and at least one of the input terminal and the output terminal; and a housing including the variable resistor and having an annular shape with an opening, wherein a solid-state light-emitting element unit including the substrate and the solid-state light-emitting element is disposed in the opening, the identification terminal includes a first identification terminal and a second identification terminal for outputting to the lighting circuit the electric signal representing the identification information as set by the variable resistor, the input terminal includes a first input terminal and a second input terminal that are connected together, the output terminal includes a first output terminal and a second output terminal that are connected together, the variable resistor includes:

a first resistor connecting the first identification terminal and one of the first input terminal and the first output terminal; and a second resistor having a resistance value different from a resistance value of the first resistor and connecting the second identification terminal and one of the second input terminal and the second output terminal, and the variable resistor variably generates an identification signal when the first input terminal, the first output terminal, and the first identification terminal or the second input terminal, the second output terminal, and the second identification terminal are connected to the lighting circuit.

4. A lighting assembly comprising:

the solid-state light-emitting element module according to claim 3; and a luminaire including the lighting circuit.

* * * * *